US005114041A

United States Patent [19]

DiForte

[11] Patent Number: 5,114,041

[45] Date of Patent: May 19, 1992

[54] INFLATABLE LIFE BELT

[76] Inventor: Mario P. DiForte, P.O. Box 8537, Baltimore, Md. 21234

[21] Appl. No.: 709,189

[22] Filed: Jun. 3, 1991

Related U.S. Application Data

[62] Division of Ser. No. 449,797, Dec. 13, 1989, Pat. No. 5,022,879.

[51] Int. Cl.[5] ..... B67B 7/50

[52] U.S. Cl. ..... 222/6; 222/5; 441/94

[58] Field of Search ..... 441/92, 93, 94, 101; 222/5, 6

[56] References Cited

U.S. PATENT DOCUMENTS

| | | | |
|---|---|---|---|
| 2,324,744 | 7/1943 | Ward | 441/94 |
| 2,451,474 | 10/1948 | Craig | 441/94 |
| 3,113,327 | 12/1963 | Cook | 222/5 |
| 3,121,240 | 2/1964 | Mackenzie | 441/94 |
| 3,147,885 | 9/1964 | Sheridan | 222/5 |
| 3,161,322 | 12/1964 | Stone | 222/5 |
| 3,536,232 | 10/1970 | Lightcap | 222/5 |
| 3,625,541 | 12/1971 | Frazier | 222/5 |

FOREIGN PATENT DOCUMENTS

| | | | |
|---|---|---|---|
| 1048601 | 11/1966 | United Kingdom | 222/5 |

*Primary Examiner*—Sherman Basinger
*Assistant Examiner*—Thomas J. Brahan
*Attorney, Agent, or Firm*—Shlesinger Arkwright Garvey

[57] ABSTRACT

Disclosed is a compressed gas cartridge actuator assembly having an elongated main body with side by side wells. A pair of compressed gas cartridges are positioned in the wells to face in opposite directions. Each end of the elongated body has a lever and a piercing pin for selective actuation of one of the cartridges.

11 Claims, 5 Drawing Sheets

INFLATABLE LIFE BELT

This is a division of application Ser. No. 07/449,797 filed Dec. 13, 1989 now U.S. Pat. No. 5,022,879.

This invention is an inflatable life belt for use by boaters or the like and which may be quickly inflated to keep an individual float in the water.

BACKGROUND OF THE INVENTION

Over the years, many boaters have drowned as a result of a boating mishap or being thrown into the water in rough seas. In order to reduce these accidents, the U.S. Coast Guard has required that all boats must be equipped with an approved life vest for each person on board. It is not required, however, that the life vest be worn at all times and, consequently, very few persons on board actually wear the vests unless an emergency occurs. This is due to several factors, notably, the vests are cumbersome to wear, interfere with movements of the wearer about the boat while fishing and performing other activities, and the vests are hot to wear in warm weather.

As a consequence, there are many occasions when the boater does not have the time or opportunity to put on a life vest in an emergency prior to entering the water. This happens, for example, when two boats collide, when there is an explosion on board, or the boater is thrown overboard in rough seas.

Attempts have been made to provide alternative life preservers, but these also have proven unsatisfactory for many of the above reasons and, in many instances, do not have Coast Guard approval as required by law.

SUMMARY OF THE INVENTION

The present invention is an inflatable life belt of light weight, compact construction which is normally worn around the waist or hips of the individual, the size of which life belt does not interfere with the activities of the individual while on board the ship, thereby rendering it feasible to use at all times without discomfort or in any way hindering normal physical activities.

The belt of the present invention encircles the body and is detachably engaged therewith by suitable belt means, the belt comprising two buoyancy sections of similar size which are folded one on top the other for sake of compactness.

Each section of the belt includes a closed chamber at least one of which is automatically inflatable by suitable means such as a compressed gas cartridge mounted on the belt.

The other closed chamber may be similarly inflated independently of the first chamber or, alternatively, may be filled with an inherently buoyant material, such as foam, to render the life belt operative as soon as the individual enters the water.

In accordance with the objects of the present invention, upon entering the water, the buoyant life belt of the present invention rides upwardly on the torso of the individual from its initial position around the waist to the upward position just below the armpits, for holding the head of the individual above water.

DESCRIPTION OF FORM OF INVENTION ILLUSTRATED IN FIGS. 1 TO 8

Figure 1:
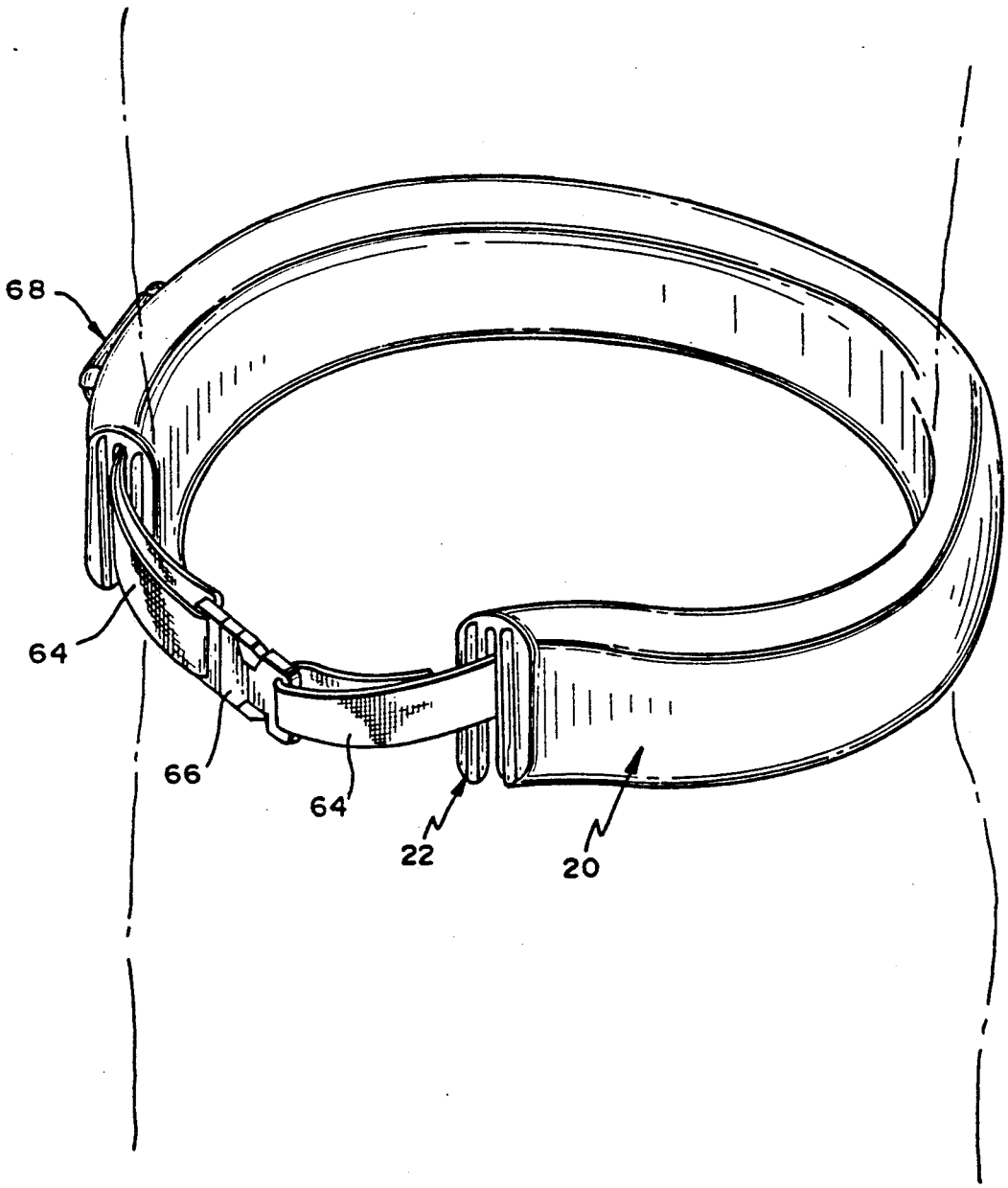
FIG. 1 is a perspective view of the inflatable life belt of the present invention, illustrating its use, and showing the life belt in operative position.
Figure 2:
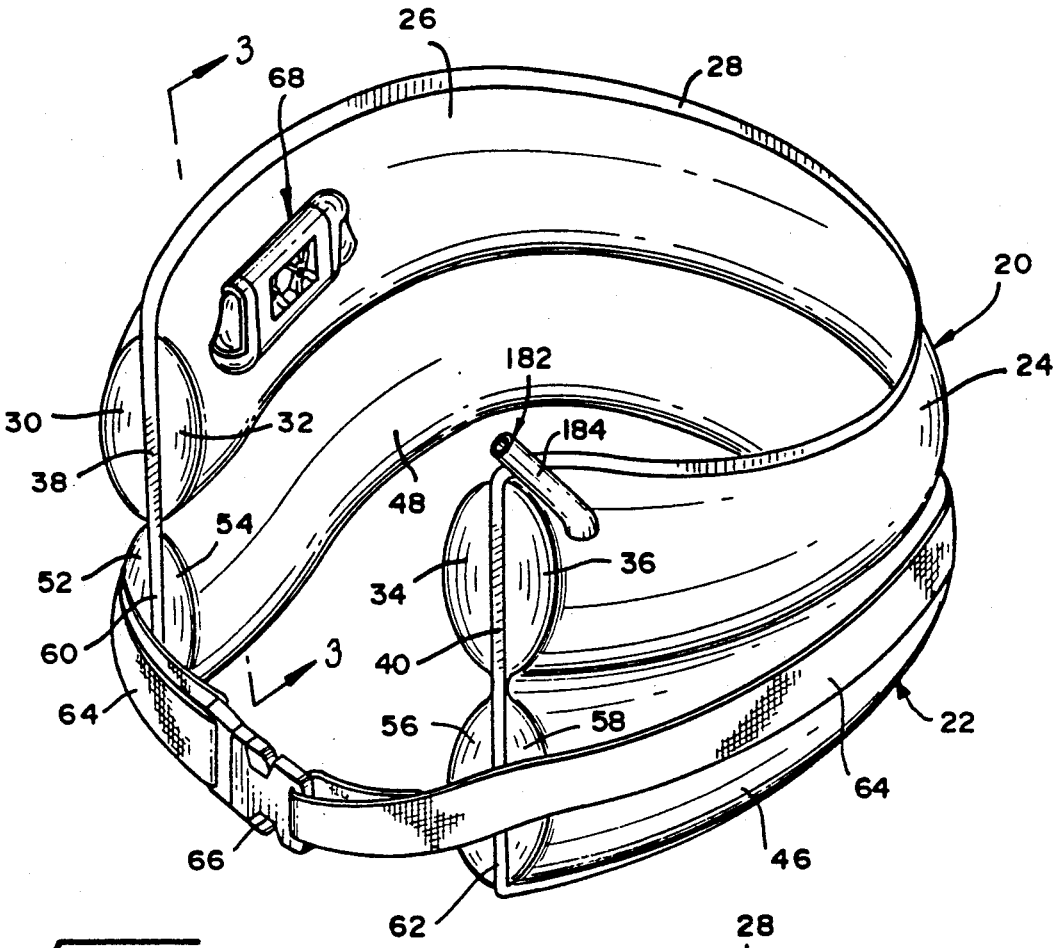
FIG. 2 is a view similar to FIG. 1 showing the life belt in operative position.
Figure 3:
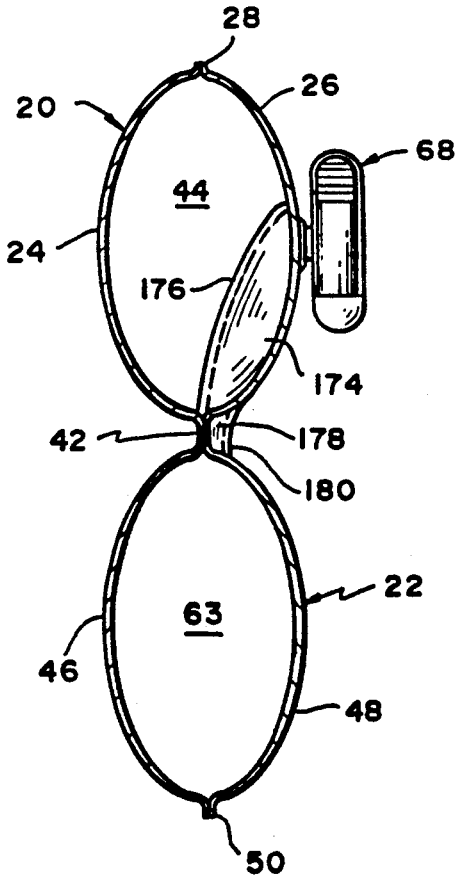
FIG. 3 is a sectional view taken along line 3—3 of FIG. 2, looking in the direction of the arrows.
Figure 4:
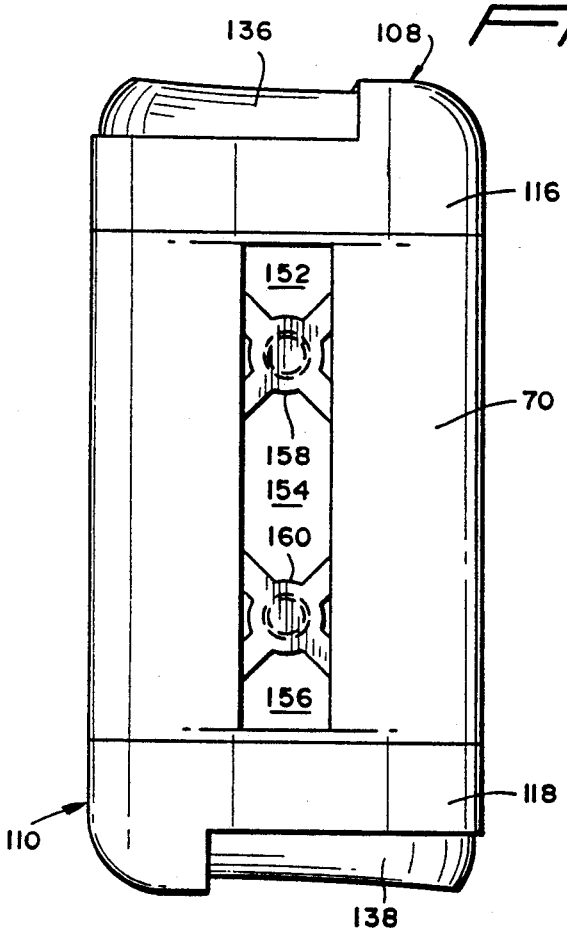
FIG. 4 is a front elevational view of an inflating actuator assembly forming a part of the present invention.

In FIGS. 1 to 8, there is illustrated an inflatable life belt which includes a pair of overlapped, light weight, inflatable buoyancy portions 20 and 22 made of a suitable flexible, waterproof material such as coated nylon. Each of portions 20 and 22 are of elongated, generally tubular shape and, when inflated, as shown in FIGS. 2 and 3, portion 20 is superimposed on portion 22.

As also shown in FIGS. 2 and 3, the side walls of portions 20 and 22 are preferably formed from two opposed pieces of the flexible material which are joined together in a manner to form the two inflatable portions.

Inflatable portion 20 includes opposed side walls 24 and 26, the upper longitudinal edges of which are sealed together in any suitable fashion as indicated at 28. The ends of the side walls are provided with end panels 30, 32 and 34, 36 and the edges are sealed together at 38 and 40. The lower edges of side walls 24 and 26 are also sealed together at 42. This forms a closed air chamber 44 within inflatable portion 20.

As shown to advantage in FIG. 3, the sealed edges 42 of sides 24 and 26 also serve as a seal for the upper edges of side walls 46 and 48 of inflatable lower portion 22. The lower longitudinal edges of side walls 46 and 48 are sealed together in any suitable manner as indicated at 50.

As shown in FIG. 2, the ends of walls 46 and 48 are closed by end panels designated 52 and 54, 56 and 58, the edges of which are sealed at 60 and 62, which are extensions of seals 38 and 40. This forms a closed air chamber 63.

Referring to FIG. 2, it will be seen that a belt member 64 having a conventional buckle 66 is fixedly engaged with the outer surface of side wall 48 of inflatable portion 22 to permit the inflatable life belt to be secured around the waist of the individual wearing the same.

By virtue of providing a pair of light weight, inflatable portions of the present construction, portion 20 may be folded over portion 22 so that, when the life belt is in its inoperative position, side wall 24 of inflatable portion 20 lies in contiguous engagement with side wall 46 of inflatable portion 22, thereby minimizing the thickness and width of the belt in its uninflated condition, with resultant reduced interference with the physical activities of the wearer.

It is a feature of the present invention to provide a gas cartridge inflation assembly 68 which is engaged with inflatable portion 20 of the life belt for automatically inflating portions 20 and 22 of the life belt.

Inflation assembly 68 is preferably of plastic molded construction and, as shown in FIGS. 4 to 8, includes a main body portion 70 having a pair of longitudinally extending, spaced wells 72 and 74 adapted to receive standard CO2 cartridges 76 and 78.

Each of wells 72 and 74 is extended at one end thereof to provide neck portions 80 and 82 which are externally threaded at 84 and 86.

Disks 88 and 90 are placed over the end wells 72 and 74, the disks being provided with inwardly extending flanges 92 and 94 which lie in contiguous engagement with the inner end of neck portions 80 and 82. Flanges 92 and 94 are in spaced relation to the outer periphery of disks 88 and 90, and O-rings 96 and 98 are interposed between disks 88 and 90 and the terminals of neck portions 80 and 82.

The outer faces of disks 88 and 90 are provided with central protuberances 100 and 102 in which are positioned pins 104 and 106 for piercing the upper end of cartridges 76 and 78.

The gas cartridge inflation assembly further includes a pair of actuator lever housings 108, 110 which comprise a base member of generally U-shaped cross-section which includes a bottom wall 112, 114, side walls 116, 118, and end walls 120, 122.

Figure 6:
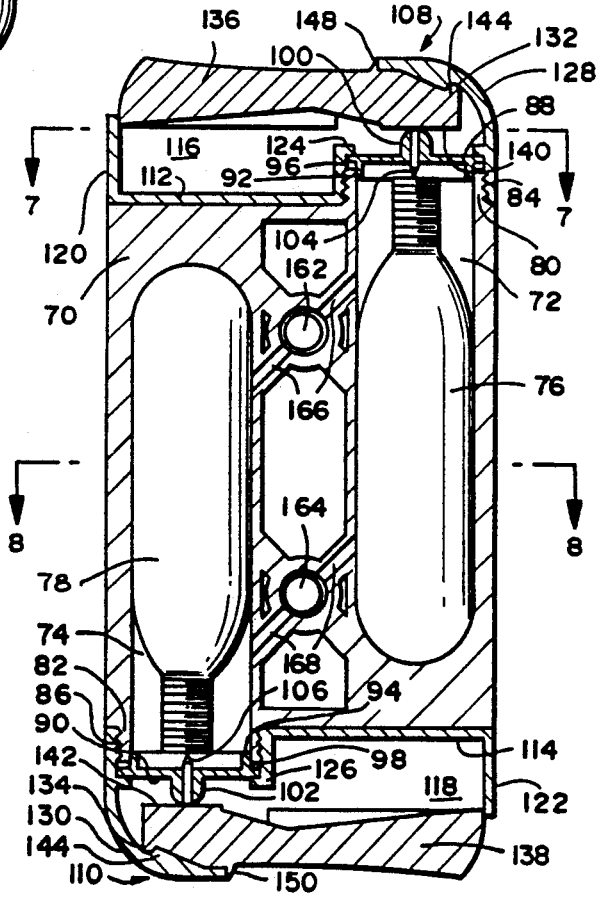
FIG. 6 is a longitudinal sectional view of the inflating actuator assembly.

As shown to advantage in FIG. 6, one end of actuating lever housing 108 is provided with an internally threaded tubular portion 124, 126 which is threadedly engaged with externally threaded neck portions 80, 82 of main body portion 70, for engaging the actuating lever housings with the main body portion.

One end of actuator lever housings 108, 110 are provided with curved walls 128, 130 which extend upwardly and inwardly of the housing in superimposed relation to disks 88, 90 of the assembly. The inner surfaces of walls 128, 130 are provided with abutment members 132, 134 for purposes which will be hereinafter more fully set out.

Actuating lever housings 108, 110 are adapted to receive elongated actuating levers 136, 138 which are movably supported in lever housings 108, 110. Actuating levers 136, 138 include flat bottom wall portions 140, 142 which are adapted to normally rest on central protuberances 100, 102 of disks 88, 90. Actuating levers 136, 138, are also provided With abutments 144, 146 which complement, and are adapted to engage abutment members 132, 134 of curved walls 128, 130 of actuating lever housings 108, 110.

In association with abutment members 144, 146, there are provided second abutment members 148, 150 which engage the ends of curved walls 128, 130, the abutment members serving to maintain actuating levers 136, 138 within housings 108, 110 prior to actuation.

Figure 5:
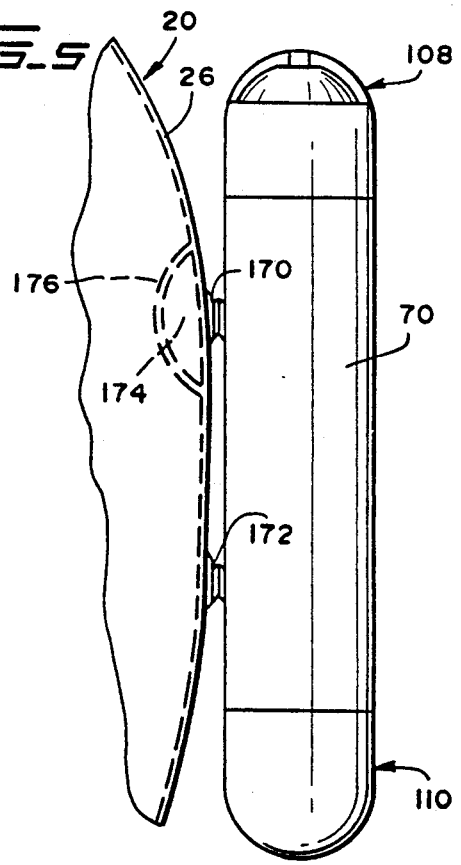
FIG. 5 is a side elevational view of the inflating actuator assembly shown in operative position attached to the inflatable life belt.

It will be noted from FIGS. 5 and 6 that, in order to make main body portion 70 as light weight as possible, there are provided openings indicated at 152, 154 and 156. These openings are separated by webs 158, 160 for joining the segments of the main body portion together. Webs 158, 160 include central openings 162, 161 for admitting compressed gas from cartridges 76 and 78 to the life belt through a series of tubular branches connecting openings 162, 164 to wells 72, 74, as indicated at 166, 168. As indicated in FIGS. 3 and 5, openings 162 and 164 of gas cartridge inflation assembly 68 are operatively engaged with inflatable portion 20 of the life belt by conventional valve means 170, 172 for admitting compressed air to inflatable portions 20 and 22 by actuation of levers 136 and 138. In view of the fact that the gas cartridge inflation assembly is engaged only with inflatable portion 20, there is provided a conduit 174 formed between a side wall 26 of inflatable portion 20 and a curved wall 176 which extends through inflatable portion 20 to inflatable portion 22, the ends of which curved wall are joined to side wall 48 in spaced relation to the valve 170.

As illustrated in FIG. 3, a connecting conduit 178 is formed between upper and lower inflatable portions 20 and 22 at seal 42 by means of a small wall 180 extending between wall 26 of inflatable portion 20 and wall 48 of inflatable portion 22.

As shown in FIG. 2, the life belt of the present invention is further provided with a manual inflater mechanism 182 which comprises a tube 184, one end of which is in communication with chamber 44 of inflatable portion 20. As shown to advantage in FIG. 2, tube 184 extends outwardly from the life belt at an angle to facilitate engagement of the free end of the tube by the mouth of the user for manually inflating the life belt if necessary.

OPERATION AND USE OF THE LIFE BELT ILLUSTRATED IN FIGS. 1 TO 8 OF THE DRAWINGS

The life belt is loosely placed around the waist of the user by fastening buckle 66, at which time portions 20 and 22 lie in overlapping relationship, and with the life belt in a position so it does not interfere with arm or leg movements during boating, or with other physical activities.

In the event that it becomes necessary to activate the life belt, actuating levers 136 and 138 of gas cartridge inflation assembly 68 are depressed, thereby causing a corresponding movement of pins 104 and 106 in a direction to pierce cartridges 76 and 78, to release the compressed gas contained therein.

The gas enters wells 72 and 74 and then passes through branches 166 and 168 of webs 158, 160, then it flows through openings 162, 164, and through Valves 170, 172 into inflatable portion 20. A portion of the compressed air enters chamber 44, and the remaining portion flows to conduits 174 and 178 into chamber 63 of inflatable portion 22.

This causes the two portions of the belt to assume the position shown in FIGS. 2 and 3, with inflatable portion 20 in superjacent relation to inflatable portion 22.

Upon entering the water, because of the buoyancy of the inflatable portions of the life belt, the belt rises upwardly until it engages the armpits, at which point it is in the optimum position for maintaining the head of the wearer above water for a indefinite period of time.

In the event that inflation of portions 20 and 22 does not occur due to failure of the gas cartridges, then the wearer may inflate upper portion 20 of the life belt manually by blowing into the end of tube 184 of manual inflator 182 to effect sufficient buoyancy of the life belt to maintain the wearer of the belt above water.

DESCRIPTION OF FORM OF INVENTION ILLUSTRATED IN FIGS. 9 TO 12

In FIGS. 9 to 12, there is illustrated a modified form of the present invention generally designated 186, and wherein portions thereof which are similar to that disclosed in the form of invention illustrated in FIGS. 1 to 8 are designated by like, primed members.

In this form of invention, instead of providing a pair of air chambers which are inflatable by means of a gas cartridge, there are provided a pair of chambers, one of which, 20', is similar to inflatable portion 20 in the form of invention illustrated in FIGS. 1 through 8. However, in this form of the invention, there is provided a second noninflatable portion 200 which comprises a pair of flexible side walls 202 and 204 which are connected to portion 20' by seam 42', and the opposite ends of the sides are sealed at 206. In accordance with the objectives of this form of the invention, a foam block 208 is placed within portion 200 between walls 202, 204 which is coextensive therewith. Foam block 208 may be made of any suitable material such as a closed cell foam of high buoyancy, called ENSOLITE which is a Coast Guard approved material.

Figure 9:
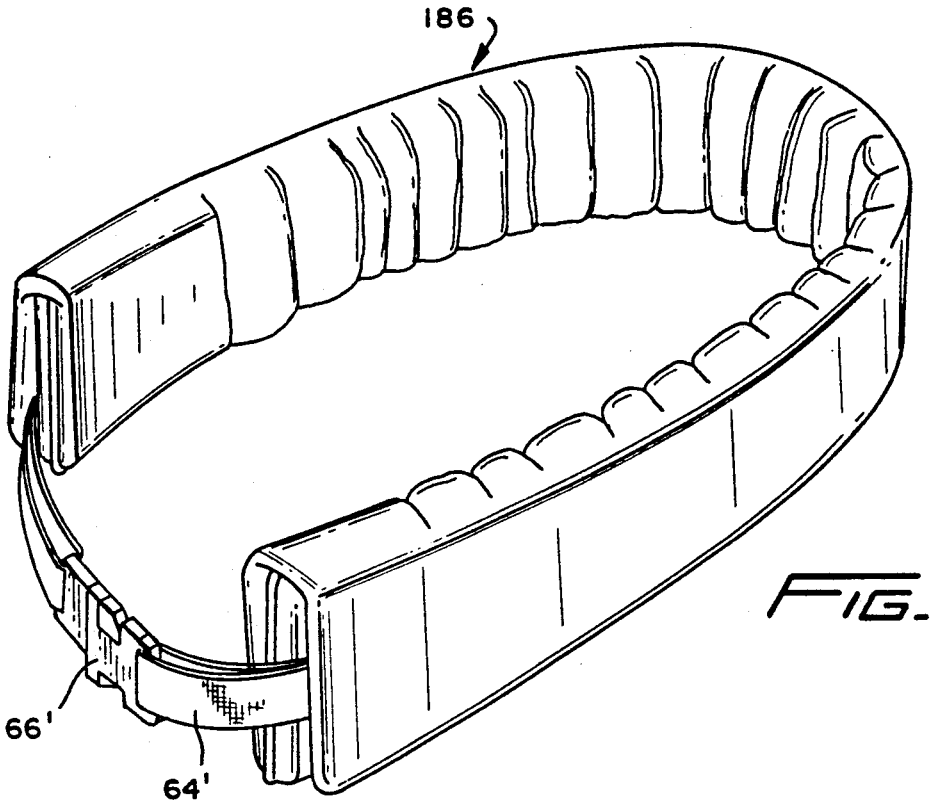
FIG. 9 is a perspective view of a modified form of an inflatable life belt, showing the same in operative position.
Figure 10:
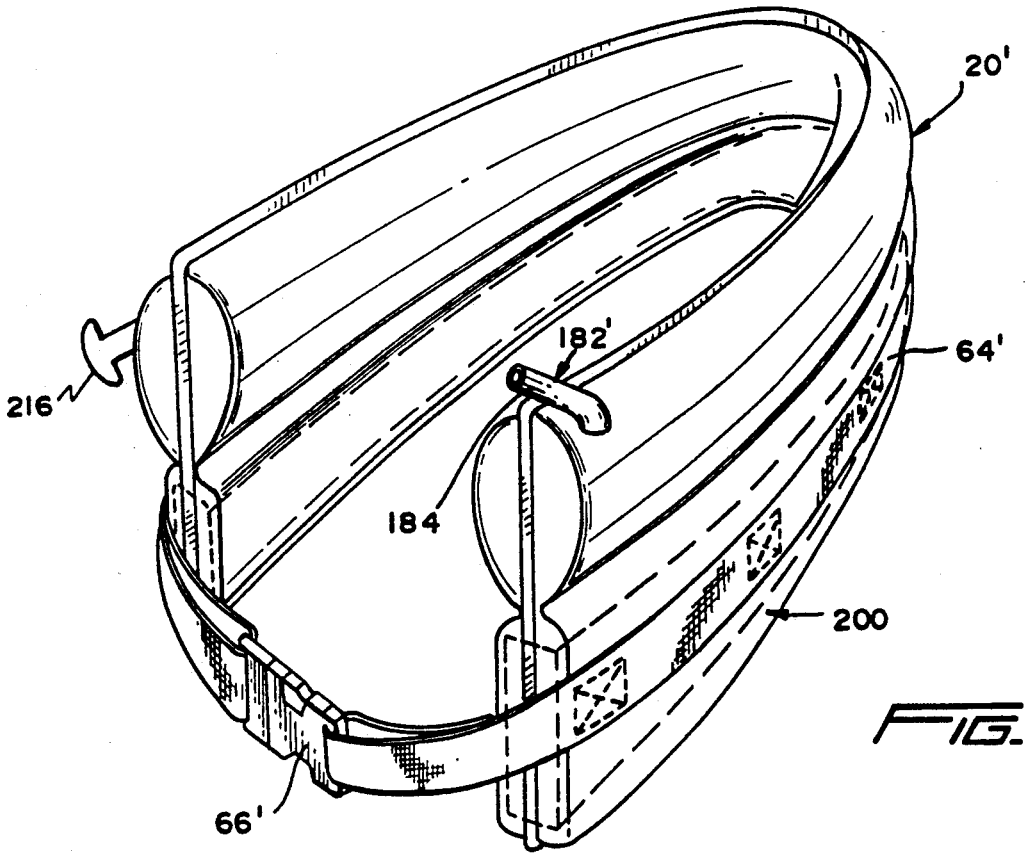
FIG. 10 is a perspective view of the form of th invention illustrated in FIG. 7, showing the same in operative position.
Figure 11:
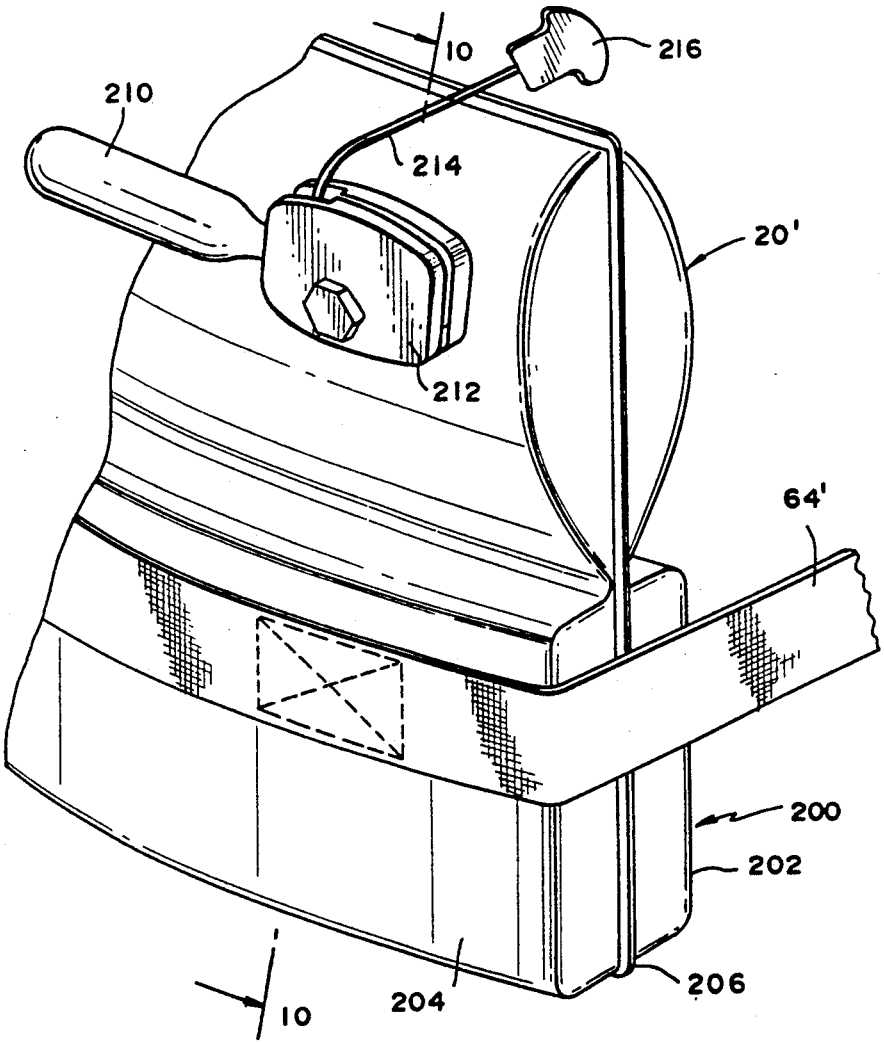
FIG. 11 is an enlarged fragmentary perspective view of the inflatable life belt as shown in FIGS. 7 and 8, showing in advantage the inflating actuator assembly.
Figure 12:
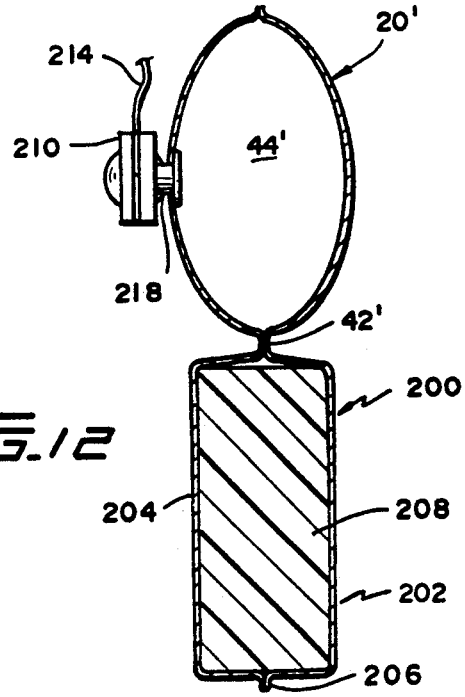
FIG. 12 is a sectional view taken along line 10—10 of FIG. 9 looking in the direction of the arrows.

As shown to advantage in FIGS. 9 and 10, inflation of inflatable portion 20' may be effected by means of a single CO2 Cartridge 210 which is actuated by conventional means such as a Halkey Roberts actuator 212 having a flexible cable 214 and a pull tab 216 to pierce gas cartridge 210 and effect passage of gas through a standard valve 218 into chamber 44' of inflatable portion 20'.

Just as in the form of invention illustrated in FIGS. 1 through 8, there is provided a manual inflation tube 182' comprising a tube 184' for manually inflating inflatable portion 20' in the event of failure of the automatic compressed gas actuating assembly.

Figure 7:
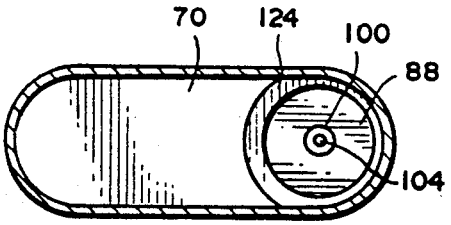
FIG. 7 is a sectional view taken along the line 7—7 of FIG. 6, looking in the direction of the arrows.
Figure 8:
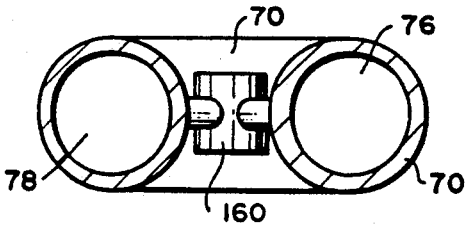
FIG. 8 is a sectional view taken along the line 8—8 of FIG. 6, looking i the direction of the arrows.

As shown in FIGS. 7 and 8, the modified form of the present life belt is worn in the same manner as in the form of the invention illustrated in FIGS. 1 through 8, with the deflated portion 20' folded over portion 200. In this position, flexible cable 214 extends forwardly between portions 20 and 200 so that pull tab 216 is readily accessible.

The inflatable portion 20' is inflated by pulling tab 216 to actuate flexible cable 214 causing gas cartridge 210 to be pierced and the compressed gas to flow into chamber 44'. As this occurs, the life belt assumes the position shown in FIG. 10, the belt rides upwardly to a point under the armpits of the wearer, and the combination of the two buoyancy portions holds the head of the person above water.

In this form of the invention, foam 208, because of its inherent buoyancy, will serve to initially keep the wearer of the life belt a float even in the absence of inflation of inflatable portion 20' so that, if inflation occurs after the wearer of the life belt enters the water, he will be kept afloat by buoyancy portion 200.

If desired, the gas cartridge inflation assembly 68 used in connection with the form of the invention illustrated in FIGS. 1 to 8, may also be used with the modified form of the invention illustrated in FIGS. 9 to 12. In the event that this is done, then both cartridges are operatively engaged with chamber 20' and, when it is desired to inflate the same, only one cartridge is actuated. In this way, a backup cartridge is available in the event of failure of the first cartridge.

While there has been herein shown and described the presently preferred forms of this invention, it is to be understood that such has been done for purposes of illustration only, and various changes may be made therein within the scope of the appended claims.

What is claimed is:

1. A compressed gas cartridge actuator assembly comprising:

a) a housing comprising a main body portion of elongated rectangular conformation;

b) said main body portion having wells extending in side by side relation longitudinally thereof;

c) compressed gas cartridges each having a top and bottom positioned in said wells with the tops thereof facing in opposite directions;

d) conduits means extending from said main body portion wells to a point exteriorly of said housing;

e) actuating lever housings engaged with opposite ends of said main body portion;

f) a lever movably mounted in each of said lever housings, a portion of each of said levers being selectively movable towards the top of said compressed gas cartridges;

g) disks positioned in each of said wells between said levers and the tops of said compressed gas cartridges;

h) piercing means carried by said disks and extending inwardly of said main body portion wells adjacent the tops of said compressed gas cartridges;

i) said disks being selectively moved in the direction of said compressed gas cartridges under urging of said movable portion of one of said levers, upon actuation thereof, to move said piercing means into rupturing engagement with said compressed gas cartridge, whereby gas flows through said conduit means to a point exteriorly of said housing.

2. The compressed gas cartridge actuator assembly of claim 1, wherein:

a) said conduit means includes a web in said main body portion between said main body portion wells;

b) an opening in said web extending to a point exteriorly of said housing: and c) tubular conduit in said web connecting said wells to said opening.

3. The compressed gas cartridge actuator assembly of claim 2, wherein:

a) said conduit means includes a second web in said main body portion between said main body portion wells and in spaced relation to said web;

b) a second opening in said second web extending to a point exteriorly of said housing, and c) second tubular conduits in said second web connecting said wells to said second opening.

4. The compressed gas cartridge actuator assembly of claim 3, wherein:

a) said piercing means comprises a pin mounted in each of said disks.

5. The compressed gas cartridge assembly of claim 1, wherein:

a) each of said actuator lever housing includes curved walls which extend upwardly and inwardly of this housing in superposed reaction to said disks;

b) the inner surfaces of said curved walls being provided with abutment members;

c) said actuating levers being provided with abutments which complement, and are adapted to engage, said abutment members of said curved walls; and d) means associated with said disks for maintaining said levers in engagement with said lever housing walls.

6. The compressed gas cartridge assembly of claim 5, wherein:

a) said means comprises a proturberance extending outwardly from one face of each of said disks into engagement with each of said levers.

7. The compressed gas cartridge of claim 6, wherein:

a) said piercing means is a pin positioned in said protuberance and extending through the other face of said disk to a point adjacent the top of a compressed gas cartridge, said disk and pin being moved upon actuation of said lever in the direction of the compressed gas cartridge to effect rupturing of the top of the compressed gas cartridge by said pin.

8. A compressed gas cartridge actuator assembly comprising;

a) a housing having a main body portion of elongated rectangular conformation;

b) said main body portion having wells extending in side-by-side relation longitudinally thereof;

c) compressed gas cartridges, each having a top and bottom, positioned in said wells with the tops thereof facing in opposite directions;

d) conduits extending from said gas cartridges to points exteriorly of said housing;

e) actuating lever housings engaged with opposite ends of said main body portion;

f) each of said actuating lever housings having a lever movably mounted in the actuating lever housing, a portion of which lever is movable towards the top of one of said compressed gas cartridges, and g) a gas cartridge piercing member interposed between the movable portion of each of said actuator lever housings and each of said compressed gas cartridges;

h) said gas cartridge piercing member being urged by said movable portion of said lever into rupturing engagement with the top of one of said gas cartridges.

9. The compressed gas cartridge actuator assembly of claim 8, wherein:

a) the levers of said actuating lever housings are selectively operable independently of each other.

10. A compressed gas cartridge actuator assembly comprising;

a) a housing having a main body portion of elongated rectangular conformation;

b) said main body portion having wells extending in side-by-side relation longitudinally thereof;

c) compressed gas cartridges, each having a top and bottom, positioned in said wells with the tops thereof facing in opposite directions;

d) conduits extending from said gas cartridges to points exteriorly of said housing;

e) actuating levers movably connected to opposite ends of the main body portion of said housing, and f) a gas cartridge piercing member interposed between the top of each compressed gas cartridge, and a portion of each of said levers;

g) said levers being selectively manually actuated to engage and urge said gas cartridge piercing members into rupturing engagement with the top of said compressed gas cartridges to effect passage of this compressed gas through said conduits to a point exteriorly of said housing.

11. The compressed gas cartridge assembly of claim 10, wherein;

a) said gas cartridge piercing members comprise pins for puncturing the tops of said gas cartridges.

* * * * *